United States Patent [19]

David

[11] 4,338,047

[45] Jul. 6, 1982

[54] SYSTEM FOR PIER UNDERPINNING OF SETTLING FOUNDATION

[75] Inventor: Lloyd M. David, St. Louis, Mo.

[73] Assignee: E. F. David, Inc., St. Louis, Mo.

[21] Appl. No.: 187,402

[22] Filed: Sep. 15, 1980

[51] Int. Cl.[3] ..... E02D 27/48; E02D 35/00

[52] U.S. Cl. ..... 405/230

[58] Field of Search ..... 405/229, 230, 233; 52/169.1

[56] References Cited

U.S. PATENT DOCUMENTS

| | | | |
|---|---|---|---|
| 1,063,869 | 6/1913 | Goldsborough | 405/230 |
| 1,644,572 | 10/1927 | Ferry et al. | 405/230 |
| 3,796,055 | 3/1974 | Mahony | 405/230 |

FOREIGN PATENT DOCUMENTS

| | | | |
|---|---|---|---|
| 325093 | 2/1930 | United Kingdom | 405/230 |

*Primary Examiner*—David H. Corbin
*Attorney, Agent, or Firm*—Paul M. Denk

[57] ABSTRACT

A system for pier underpinning of settling foundations, wherein each pier comprises a column of pipe sections perpendicularly arranged downwardly aligned directly beneath the foundation footing, in the vicinity of its settling, the column extending into contact with the earth's bedrock, the column being fomed by a series of said pipe sections having sufficient internal diameter to accept a supply of concrete during the formation of a cap upon the upwardly disposed pipe section, a mechanical jack arranged immediate the underside of the footing and the top of the concrete cap and tightened therebetween, to support the footing thereon, and a supply of concrete forming a concrete support around the emplaced jack and upon the formed cap for forming a complete pier for adding support to the foundation and its footing; and a method of forming the pier, a hydraulic jack is used for driving the pipe sections into the ground, until bedrock is encountered, and then said hydraulic jack is removed for replacement by the mechanical jack, after the concrete cap is formed, with a vibrating device utilized for providing compaction of the poured concrete cap and support sections to assure thorough concrete compaction before its setting.

6 Claims, 5 Drawing Figures

SYSTEM FOR PIER UNDERPINNING OF SETTLING FOUNDATION

BACKGROUND OF THE INVENTION

This invention relates generally to the shoring of foundations, and more specifically pertains to a method and arrangement of components for providing pier underpinning of settling foundations.

The settling of foundations or buildings, residences, or the like, has perennially been a problem for the homeowner, and his contractor, after acquisition of particularly new constructions. In certain areas where new buildings are constructed upon fill material, subsequent settling of the ground frequently leads to foundation problems either in the form of its cracking, or settling, which must be remedied in order to prevent sbbstantial damage that normally necessitates expensive repairs to the building substructure. In addition, where buildings may be constructed upon ground that is formed of clay or other related type materials, and which during dry spells frequently shrinks and contracts to the extent that building settling occurs, some supplemental support must be provided for the building foundation in order to prevent the building from sustaining major damage of its integral structure.

Numerous methods have been devised for remedying the problem of building settling, many of them requiring substantial manual labor accomplishing their intended results, or in the alternative, providing a rather quick method for shoring up a building foundation, but generally only providing temporary relief due to the lack of integral support that may be provided and needed to the entire building per se.

A variety of prior patents have issued upon inventions in this field, and one such early invention is disclosed in the U.S. Pat. No. 263,130 to Breuchaud, wherein there is disclosed a preliminary concept that utilizes hydraulic or other jack means located within a dugout recess provided proximate the foundation wall, particularly at that location where the building is sinking, then through the use of jacks provides for a driving of a plurality of column sections down into the ground until bedrock is encountered, and then locating a series of beams upon the top column section for use in forming a support for the foundation or wall.

A more recent patent, that being disclosed in the U.S. Pat. No. 3,796,055 to Mahony, discloses another method and apparatus for underpinning and raising a building foundation, wherein a jack is placed adjacent the side edge of a building foundation portion, with pipe pile sections then being driven into the ground a sufficient distance until solid material is encountered and which is contemplated to support the foundation structure. Following this, a cap is placed onto the top pipe pile, and a concrete pad is poured thereupon having the base of a jack also embedded therein. The jack is then raised into place contacting the underside of the foundation wall, after a mechanical jack is actuated for raising the foundation to its desirable unsettled level. Finally, this jack or support is embedded in place within the body of the poured concrete. Unlike the current invention, the concept of this patented invention does not include the formation of a concrete pier, by pouring concrete down into the pipe pile sections, after bedrock is encountered. In addition, the pipe sections are arranged apparently slightly laterally of the foundation, rather than directly beneath it, due to the nature of the driving assembly that is utilized in the disclosed methods.

A variety of other patents that have also issued upon this concept are as follows. The earlier patent to Breuchaud, U.S. Pat. No. 957,844, discloses other means for providing pipe sections underneath a foundation for supporting the same. In addition, the U.S. Pat. No. 3,685,301 to Heacox, and the patent to Goldsborough, U.S. Pat. No. 1,063,869, disclose other more complex structures for underpinning buildings, with the former patent utilizing means for embedding of cylinders into the ground to provide support for the foundation wall. The patent to Clark, U.S. Pat. No. 1,181,212, discloses the driving of pipes into the ground for underpinning foundation walls, while the U.S. Pat. No. 918,100 to Thomson discloses another method for performing the same. Finally, the construction of supports for walls is shown in still another U.S. Pat. No. 570,370 to Mr. Breuchaud.

It is, therefore, the principal object of this invention, particularly in view of what has been previously developed, to provide means and apparatus for forming steel cylinder reinforced concrete piers that extend down to bedrock in their emplacement, without necessitating the digging of earth down to such level during the pier installation.

Another object of this invention is to provide means for underpinning a settling foundation through the application of quantities of poured concrete that not only form the concrete and steel combined piers for the underpinning construction, but likewise, such poured concrete is useful for providing a support between the capped off formed piers and the underside of the foundation footing to be supported.

Still another object of this invention is to provide the concept of embedding a mechanical or other type of jack directly within the formed concrete support furnished for shoring up the sagging foundation.

Still another object of this invention is to provide the concept of vibrating the poured concrete during its application for forming the concrete piers, caps, and support for a foundation wall so as to assure its compaction before setting and curing.

Still another object of this invention is to provide a series of pipe sections that connect together and can be firmly driven into the ground through the use of hydraulic jack means for encountering bedrock before any concrete is poured in formation of the foundation support.

Still another object of this invention is to provide a method for performing the foregoing operations, for constructing the type of foundation support described, and which process can be accomplished through a minimum use of manual labor than had heretofore been required.

These and other objects will become more apparent to those skilled in the art upon reviewing the summary of this invention, and upon undertaking a study of the description of its preferred embodiment, in view of the drawing.

SUMMARY OF THE INVENTION

This invention contemplates a method for providing stable pier underpinnings for a settling foundation, and in addition, describes the various components that cooperate to achieve the performance of the defined method.

This system for pier underpinning of this invention, and distinct from what has previously been the norm in this phase of construction, a cavity is dug under that portion of the foundation subjected to settling, with the cavity only being sufficiently big enough to allow the insertion of the various components necessary for obtaining foundation support. For example, the concept of this invention includes the use of various pipe sections, generally being somewhere in the vicinity of one to two foot in length, with the initial pipe section having a downwardly pointed end for effectively piercing the ground into which it is driven by means of a hydraulic or other powered jack means. Thus, the cavity need not be more than approximately five feet in depth, and generally being dug to a sufficient distance under the foundation to allow the emplacement of the jack approximately under the center of the foundation accompanying footing, and also to provide sufficient clearance for the locating of a poured concrete support that generally cradles the underside of the footing to be shored.

The emplaced hydraulic jack is then energized for exerting significant force upon the initial pipe section in order to drive it into the ground, and when the limits of the jack extention is reached, additional pile sections can be interfitted upon the top of the just inserted pipe section, and once again the hydraulic jack means energized for continuously driving these pipe sections into the ground until that depth is obtained when bedrock or other firm support is encountered. This may be as much as twenty feet or more below the ground surface. Usually the hydraulic jack means used with this invention normally can exert a force of from approximately fifteen to twenty tons or pressure, for driving these pipe sections into the ground. Once bedrock is encountered, the hydraulic jack is removed, and concrete is then poured into the pipe sections, which may be approximately five inches, more or less, in diameter, so that the interior of the pipes sections are filled with concrete, to provide supplemental support for forming a concrete type pier, followed by the application of sufficient concrete to form a cap upon the top of the uppermost pipe section, said cap generally somewhere in the vicinity of approximately two to four feet in heighth. In addition, the formed concrete cap may have dimensions that are equivalent to the width of the foundation footing, generally somewhere in the vicinity of thirty-two inches along a side. Once this is accomplished, and the concrete has firmly set, the hydraulic jack once again is located in the spacing between the top of the formed concrete cap, and the underside of the existing footing, with said jack once again being reenergized, to exert a force upon the underside of the footing, perhaps raise it slightly, so as to eliminate or alleviate settling, at which time a mechanical jack is then positioned approximately under the mid-point of the footing, adjacent to the hydraulic jack, and resting upon the approximate center of the concrete cap, and turned in position to provide for permanent support at this location. Once the mechanical jack, as aforesaid, is in place, the hydraulic jack can be removed. Following this, the concrete is once again poured into the excavated area, for encapsulating the mechanical jack in place, and for furnishing a concrete support between the formed cap and the footing, in order to provide permanent support for the foundation at this region. The mechanical jack with its full strength being exerted upon the underside of the footing is embedded in place within the concrete, and furnishes a permanent resistance against further settling of the building at this location, even though the ground surrounding the foundation at this vicinity may have exhibited previously insufficient bearing resistence as a result of settled or desiccant soil. And, since the now formed concrete and steel combined pier is driven against the bedrock, at some depth below the foundation, adequate support is provided for the building footing, and its foundation, at this location to withstand any further settling. Where the settling that has occurred is of greater magnitude, many series of such concrete piers can be formed, at predetermined distances from each other along the length of the footing, which has been technically determined necessary for providing full support for the shored up building.

In order to assure the necessary support determined required from the concrete pier constructed according to the terms of this invention, during a pouring of the various segments of concrete into the formation of the pier, vibrating means may be utilized for embedding within the poured concrete, before its setting takes place, so as to assure complete compaction of the concrete.

DESCRIPTION OF THE PREFERRED EMBODIMENT

Figure 1:
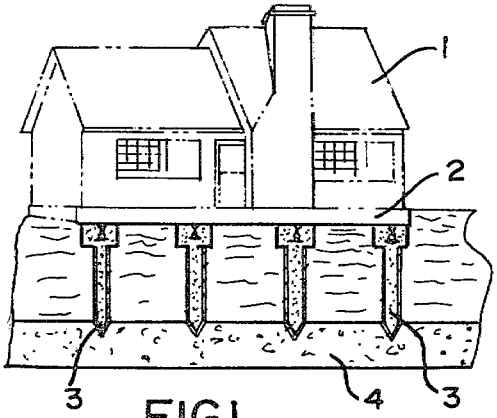
FIG. 1 discloses an isometric of a building that has been shored up through the usage of a plurality of the piers formed in accordance with the teachings of this invention.

In referring to the drawing, and in particular FIG. 1, there is disclosed a building, or residence, 1 wherein its foundation or footing 2 may have previously encountered and experienced settling, as a result probably of insufficient bearing resistence of the subsoil below its footing elevation. Or, as frequently occurs, the natural soil may have been effected by a loss of moisture, wherein the subsoil becomes abnormally dry and contracts in volume, which shrinking reaction creates an unstable base for the foundation footings. When such occurs, and such can occur in even new and not only the older buildings, the exterior walls of the building generally exhibit some cracking, as does the inside plaster for the residence. As a result, some form of base support must be provided, which in this particular invention, comprises a series of selectively placed and particularly formed piers 3 that have been driven down to bedrock as at 4, to obtain assured support for the building.

Figure 2:
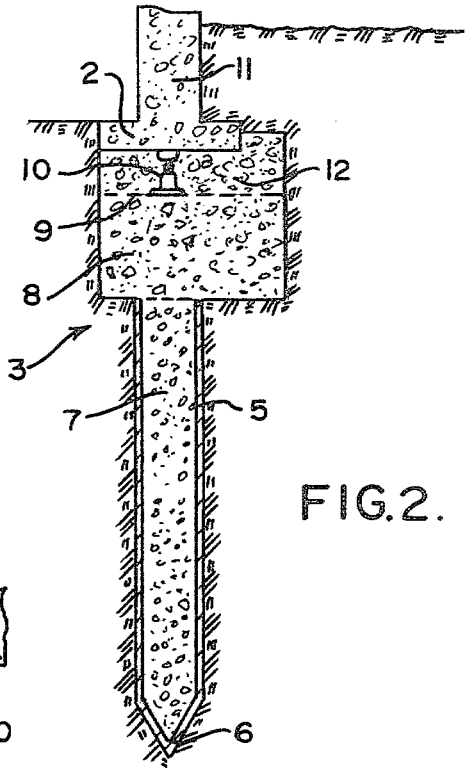
FIG. 2 discloses a sectional view taken transversally along the building footing, showing the various segments of concrete and pipe sections forming the pier of this invention.

In referring to FIG. 2, the totally formed pier 3 of this invention is disclosed, and comprises a series of segments of pipe sections 5 wherein its downwardmost terminus, as at 6, is formed pointed to facilitate its piercing the ground during insertion. These pipe sections may be approximately five inches, more or less, in diameter, but at least having sufficient spacing to allow for the insertion of concrete, as at 7, therein, so that the formed pier will be constructed as a combination of concrete and steel to assure total support for the building it is intended to uphold. In addition, encasing the concrete within the pipe sections 5 further prevents the continuous exposure of the concrete pier 7 to moisture thereby lessoning concrete deterioration which would otherwise occur if the pier is unencased within the pipe sections 5, as aforesaid. Provided upon the upper end of the pier section is the concrete cap 8, which is poured simultaneously with the pouring of the concrete pier 7, and reinforcing rods (not shown) may cooperate with the concrete poured within the column 7, and extend in transition between the cap 8 and the concrete 7, to assure continuity of strength between these two components. Arranged resting upon the upper surface 9 of the concrete cap 8 is a mechanical jack 10, and which jack will have previously been located into a centering position beneath the building footing 4, and its foundation wall 11, to assure that when the mechanical jack is stressed into position, and forcefully acts to slightly raise or prevent any further settling of the foundation wall, and its footing, that stable and permanent support for the building can be furnished through its location. Finally, a concrete support, as at 12, is poured into position, encapsulating the mechanical jack 10, which remains in place, with the support 12 providing full supplemental support beneath the entire width of the shown footing 4, to thereby stably shore up the foundation at this location.

Figure 3:
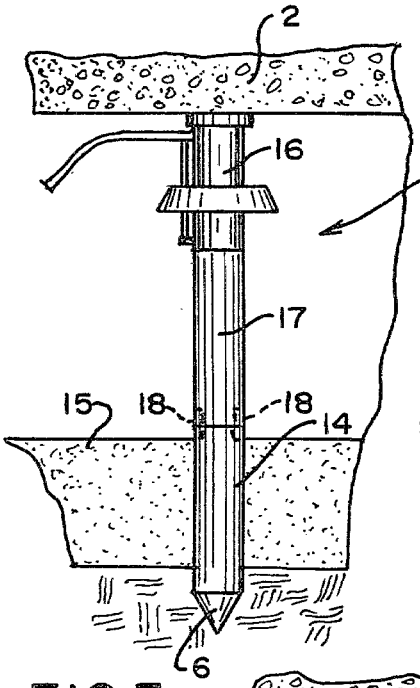
FIG. 3 discloses the application of pipe sections through the usage of a hydraulic or other jack during the formation of an underpinning pier of this invention.
Figure 4:
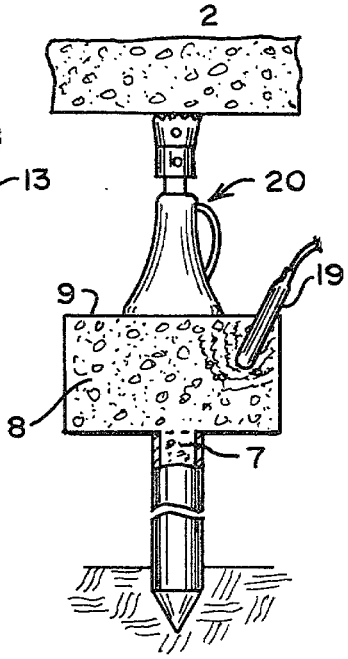
FIG. 4 discloses the locating of a mechanical jack between the formed pier and the underside of the supported footing during formation of an underpinning pier of this invention.
Figure 5:
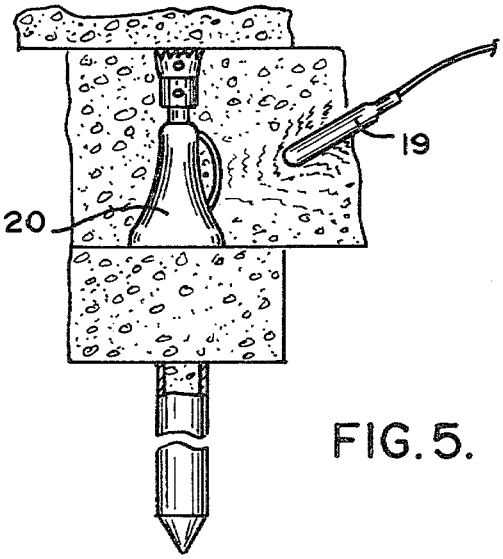
FIG. 5 discloses the finishing stage in forming the pier of this invention wherein vibration of the concrete support, during its pouring, assures its compaction during encasement of the emplaced mechanical jack.

In the method for applying the piers of this invention, and in referring to FIG. 3, a cavity, as at 13, will be probably hand excavated beneath the foundation footing 2, to a depth of approximately five feet, or less, or at least of sufficient depth to allow a worker to insert and manipulate the various pipe sections and hydraulic jack as required in the steps of performing this underpinning method. The dimensions for the excavated area, as previously explained, will also approximate the width of the foundation footing, along both its length and width. Following this, the initial pipe section, as at 14, is located upon the dugout earth, as at 15, and then a hydraulic jack means 16 will be applied to the top of the said pipe section 14, and energized, as through the application of hydraulic fluid, for driving this initial pipe section into the earth. Since these hydraulic jacks have an ability to extend approximately eighteen inches, each pipe section is formed approximating their full length. Following this, a second pipe section 17 is connected onto the top of the initial pipe section 14, and keyed into position by means of the positioning means and connectors 18, with the hydraulic jack once again being energized for driving the now combined pipe sections 14 and 17 further into the ground. This procedure continues until the lower end 6 of the pipe section 14 encounters solid rock, or bedrock, at which the further addition of pipe sections becomes unnecessary. At this time, and in referring to FIG. 4, a supply of concrete is poured into the internals of the located pipe sections, so as to form a concrete pier, as at 7, within the shown pipe sections, as can be seen in FIG. 4. In addition, adequate supply of concrete, approximately three to four feet in height, is poured to form the cap 8 integrally upon the combined pipe and concrete pier 7. As previously explained, a reinforcing rod may extend partially into the concrete pier 7, and further extend outwardly into the formed cap 8, during concrete pouring, to assure integrity of the forming pier. And, during pouring of the concrete cap, a vibrator 19 may be energized for assuring to total compaction of the poured concrete so as to provide for its complete compactness before setting. When the concrete cap 8 is set, and can withstand pressure, the hydraulic jack, once again, is located into position between the top of the cap 9, as aforesaid, and between the underside of the footing 2, and once again actuated for exerting significant force therebetween, to either slightly raise the building foundation, or at least to apply sufficient force to prevent any further settlement. When this condition is achieved, the mechanical jack, such as at 20, is located centrally under the footing, adjacent to the hydraulic jack, and also centrally upon the concrete cap 8, and heightened into position intermediate these two components, as a permanent brace and support for the building foundation, at least at this location. When this is achieved, and in referring to FIG. 5, a supply of concrete, once again, is poured into the remaining portion of the footing cavity, as previously explained at 13, to fill it entirely, in addition to encapsulating the mechanical jack 20 therein. As this is being achieved, the vibrating means 19 may once again be applied, in order to assure for complete compaction of the poured concrete, and to provide a solid concrete support, in addition through the efforts of the mechanical jack 20, for fully supporting the building foundation at this region.

And, as previously explained, a series of these constructed piers 3 may be located spacedly along the underside of the building foundation, as previously explained in reviewing the disclosure in FIG. 1. Thus, by this manner, firm support through the arrangement of a series of piers that bias against the underside of the foundation footing, and impinge at their lower end upon bedrock, furnishes full support that assures the elimination of any further settlement of the building.

Variations or modifications in the construction of the various components of this invention, or their usage in performing the process of this invention, may occur to those skilled in the art upon reviewing the subject matter of this invention. Such modifications, if within the spirit of this invention, are intended to be encompassed within the scope of any claims to patent protection issuing hereon. The description of the preferred embodiment set forth herein is done so for illustrative purposes only.

Having thus described the invention what is claimed and desired to be secured by Letters Patent is:

1. In a system for pier underpinning of settling foundations wherein each pier comprises providing a column of pipe section perpendicularly downwardly aligned directly and centrally underneath the foundation footing and in the vicinity of its settling, said pipe sections driven into the earth being axially aligned, positioning means provided upon each pipe section to facilitate its alignment and retention upon the axially arranged pipe section therebelow, said pipe sections being forced into the earth and to bedrock through the application of force from a hydraulic jack means arranged intermediate the central underside of the footing and the top edge of the upper pipe section being forced into the earth, with the first earth inserted pipe section having a pointed downward end to facilitate its movement into the ground, said column extending substantially into contact with the earth's bedrock, said pipe sections having sufficient interior diameter to accommodate the insertion and retention of concrete therein, a supply of concrete filling the said pipe sections and forming a cap thereon of sufficient thickness, a mechanical jack means arranged intermediate and centrally of the under side of the footing and upon the top of the concrete cap and tightened therebetween to support the footing thereon to alleviate foundation settling, a concrete support poured around the said jack means encasing the same therein and filling between the footing and cap for forming the concrete pier and for adding support to the said foundation and footing, said concrete formed cap and the concrete support having a width at least equal to the width of the existing footing.

2. The invention of claim 1 and wherein there are a series of said piers provided spacedly along the length of the footing and useful for alleviating foundation settling.

3. The invention of claim 1 and wherein said concrete cap and concrete support are vibrated during their pouring to assure their compaction before setting.

4. In the process of providing pier underpinning of settling foundations including providing a shallow cavity within the earth and substantially underneath the foundation footing particularly within the vicinity of its settling, arranging pipe sections within the provided cavity and directly centrally under the width of the foundation footing, with the initial section of said pipe sections having a pointed bottom to facilitate its movement under force into the ground, arranging a hydraulic jack intermediate and centrally of the underside of the footing and upon the top of the upper pipe section, actuating the said jack means to force the emplaced pipe section into the earth, positioning additional pipe sections upon the just previously embedded pipe section and driving them down also into the ground until bedrock or stable support is encountered, pouring a supply of concrete into the cavity for filling the emplaced pipe sections and for forming a cap upon the same, arranging a jack means upon the cap after concrete hardening and centrally beneath the footing and actuating the same until settling has at least subsided, replacing the jack means with a mechanical jack, and pouring a concrete support around the mechanical jack and filling the space between the footing and the cap at least to the width of the foundation footing for the purpose of adding support to the footing and its foundation.

5. The invention of claim 4 and including vibrating the poured concrete while forming the cap for insuring its compaction before setting.

6. The invention of claim 4 and including vibrating the poured concrete while forming the concrete support for assuring its compaction before setting.

* * * * *